United States Patent [19]

Stradella et al.

[11] 4,089,342

[45] May 16, 1978

[54] DISPENSING DEVICE FOR RESPIRATION APPARATUS HAVING ONE OR MORE FLOATING VALVES OPERATING ACCORDING TO AN IMPROVED SYSTEM WITH PIVOTS FREE FROM MECHANICAL CONNECTIONS

[76] Inventors: Giuseppe Stradella; Umberto Stradella, both of 13, Via Roma; Giuliano Daniele, 144D, Via Roma; Fernando Gatti, 37, Via Cavour, all of Recco (Genova), Italy

[21] Appl. No.: 602,980

[22] Filed: Aug. 8, 1975

[30] Foreign Application Priority Data

Aug. 9, 1974 Italy ..... 12928 A/74

[51] Int. Cl.[2] ..... A62B 7/04

[52] U.S. Cl. ..... 137/102; 128/142.2; 137/DIG. 9; 137/599; 137/489

[58] Field of Search ..... 128/142.2, 145.8; 137/102, DIG. 9, 599, 110, 505.12, 489, 492; 303/84 A; 28/140 R; 419/427, 442; 91/444

[56] References Cited

U.S. PATENT DOCUMENTS

| | | | |
|---|---|---|---|
| 2,871,854 | 2/1959 | Lambertsen | 128/142.2 |
| 2,897,833 | 8/1959 | Seeler | 128/145.8 |
| 2,946,340 | 7/1960 | Hollman et al. | 137/102 |
| 3,190,287 | 6/1965 | Miller, Jr. | 137/DIG. 9 |
| 3,477,462 | 11/1969 | Ray | 137/489 |
| 3,526,241 | 9/1970 | Veit | 137/489 |
| 3,752,175 | 8/1973 | Hamilton et al. | 128/142.2 |
| 3,952,773 | 4/1976 | Hahn | 137/489 |

FOREIGN PATENT DOCUMENTS

| | | | |
|---|---|---|---|
| 1,181,551 | 5/1960 | Germany | 128/142.2 |
| 1,228,481 | 4/1971 | United Kingdom | 128/142.2 |

*Primary Examiner*—William R. Cline
*Assistant Examiner*—H. Jay Spiegel
*Attorney, Agent, or Firm*—Jacobs & Jacobs

[57] ABSTRACT

Dispensing device for underwater respiration apparatus having a plurality of floating valves operating according to an improved system with pivots free from mechanical connections, said device being constructed in a single piece and comprising a central three-way distributor leading the compressed air or gas towards the center of the undersurface of a diaphragm of the floating valve, said diaphragm being located in a chamber containing a spacer member and, above the center, in a suitable central seat and loaded by a very weak spring, a service small valve with upright stem having fixedly mounted thereon an arm that operates in an upper chamber and is directly acted upon by the main control diaphragm, wherein the latter chamber communicates, through a suitable passage, both with the inspiration opening and with the expiration opening the latter containing a non-return valve, and also with the space below the undersurface of the diaphragm of said floating valve.

3 Claims, 2 Drawing Figures

DISPENSING DEVICE FOR RESPIRATION APPARATUS HAVING ONE OR MORE FLOATING VALVES OPERATING ACCORDING TO AN IMPROVED SYSTEM WITH PIVOTS FREE FROM MECHANICAL CONNECTIONS

BACKGROUND OF THE INVENTION

Substantially, the article is intended for use in the field of underwater respiration apparatus as well as in other sportive, professional or industrial applications having similar service requirements. Presently, for these applications, several types of dispensers are known, all based substantially on a lever-and-pivot system that due to inertia requires a certain inspiration effort that renders respiration uncomfortable. To overcome this difficulty, several researches and improvements have been carried out, and recently dispensing devices with reduced-inertia balanced valve have been produced, all based on complicated and costly systems comprising members requiring extreme-precision finishing, with micrometric-size air passages liable to obstructions, several springs, small pistons and many other components to be mounted in composite members that in turn must be assembled by means of mechanical systems of several types. These balanced dispensing devices, while granting acceptable results, are not reliable in operation. In facts, there operation — and more specifically the balancing action to sensitize the dispensing valve — is based upon the use of micrometric-size passages, some of which — namely those running through the thin diaphragm dispensing valve — in order to restrain the flow of feed compressed air, contain a nylon braid or a sliver or the like, which initially is efficient but after some time tends to clog like a filter, to such an extent as to block the operation of the dispensing device.

SUMMARY

This invention relates to a dispensing device for respiration apparatus having one or more floating valves operating according to an improved system with pivots free from mechanical connections.

The device according to this invention is intended to overcome said remaining drawbacks and affords a reliable, single-body dispensing device provided, in a basic embodiment, with two floating valves operating with a pivot system which is free from mechanical connections and which is, therefore, very sensitive and reliable. Said floating valves are preferably in the number of two or more, although a single-valve embodiment is within the scope of the invention, and are so arranged as to work usually in parallel, though only one of them, if necessary, could perform the same task. The construction of the embodiment according to the invention is relatively simple, and, therefore, the invention can be realized easily and economically. Moreover, the invention assures a reliable operation that, as will appear hereinafter, results directly from the simple construction of the components and from the elimination of mechanical pivots and joints which, according to one of the basic characteristics of the invention, are replaced by a valve control system which is based on an arm fixed on the stem of said valve and operating by being tilted (and not displaced axially), so that the actuation effort is almost zero. Moreover, the invention uses a disc-shaped, relatively thick dispensing valve without said micrometric-size or very narrow holes for passage of feeding air, which are required for damping the incoming flow of air.

BRIEF DESCRIPTION OF THE DRAWING

The enclosed drawing shows, as a non-limitating example, a preferred embodiment of a twin-floating valve dispensing device according to the invention. In the drawing.

DESCRIPTION OF THE PREFERRED EMBODIMENT

With reference to the Figures, the preferred two-floating valve embodiment of the dispensing device according to the invention comprises a single main body 1 made of die-cast metal, plastics or any other suitable material and having a bottom opening 2 for connection with the mouthpiece, and having in the upper portion thereof, in a V-shaped configuration, the two main floating valves. These main valves being identical and symmetrical with each other, only one of them will be described, namely the right-hand one.

Figure 1:
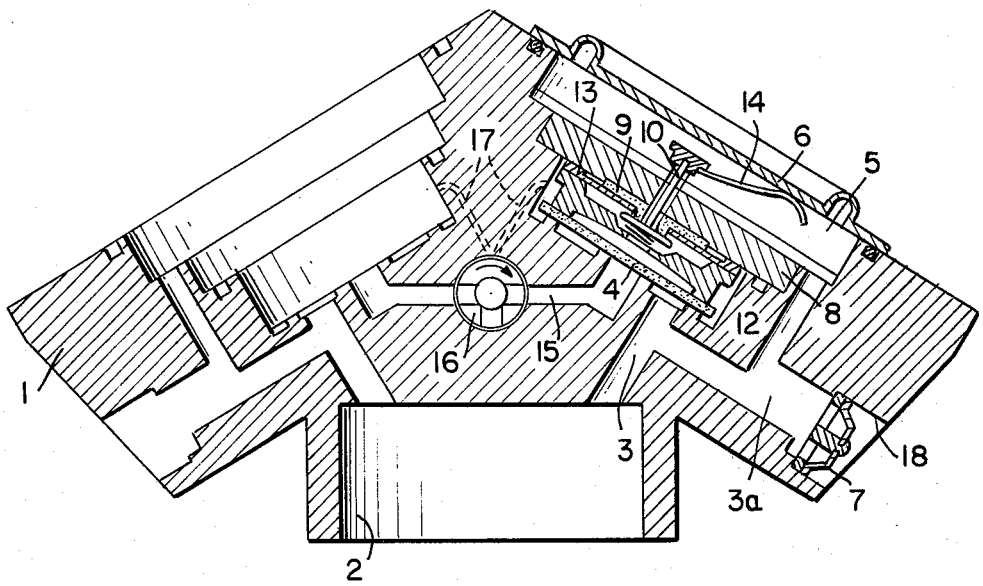
FIG. 1 is a cross-sectional view of said dispensing device wherein the main diaphragm and other components shown on the right-hand portion are omitted on the left-hand portion.

From one side of the chamber of said opening 2, a control and respiration duct 3 extends upwardly and leads into a chamber wherein a diaphragm floating valve 4 is located, opposite the undersurface of said diaphragm. Another duct **3*a* extends from one side of duct 3 and leads into an upper chamber 5 formed between a suitable seat in said body 1 and a control main diaphragm 6 that is fixed on said body by any suitable frame member, not shown. Said duct 3*a* also communicates with an expiration opening provided with a non-return valve 7. Sealingly and completely embedded in a bottom wall of said chamber 5 is a disc 8 having a central hole and having partially embedded in the undersurface thereof a disc-shaped gasket 9 that, according to a main feature of the invention, is provided with a central hole having an annular projecting sealing bead around its bottom opening. Said sealing bead is engaged by the disc-shaped valve 10 which is urged upwardly towards its closed position by a coil spring 11 the lower end of which rests against the bottom of a recessed seat in a spacer member 12 that in turn rests against the upper surface of said dispensing valve 4 that is constituted by a solid, relatively thick disc of rubber or similar material. Said spacer member 12 has an axial hole and its upper surface engages against an annular washer 13 having a central hole and intended to keep said gasket 9 in the seat therefor. According to another basic feature of the invention, the peripheral surface of said spacer member 12 and the surface thereof abutting against said washer 13 are suitably made very rough so as to allow, as will be explained later, for a seepage of air, thus avoiding any passage through any capillary hole or any larger hole with a restraining insertion of nylon braid or the like. Fixedly mounted on the free end of the servo-control valve 10, approximately perpendicularly to the axis of said valve, is a control arm 14 resting against the undersurface of said main diaphragm 6. As may be seen, the undersurface of the disc-shaped valve 4 rests on two annular projections, a peripheral one and a central one, located around the opening of the feeding duct 15, which therefore is a normally-closed duct. Said duct 15 leads to a central three-way valve or rotating diverter 16 through which the feed gas flows in. By means of said valve 16, both floating valves can be parallely connected, or either of them can be cut out. From a rear axial chamber of said valve 16 extend, in a V-shaped configuration, two auxiliary ducts 17 of reduced diameter but not of micrometric size, which lead, respectively, to the seat of one of said diaphragm valves 4. In FIG. 1, said ducts 17 are shown in dotted lines as they are in a plane which is behind the sectional plane of said Figure. These ducts 17 are intended to balance said valve diaphragm 4 according to a principle which will be explained hereinafter. Finally, said control and respiration duct 3***a* communicates also with an expiration opening 18 having mounted therein a non-return valve 7 that in this instance is formed by a resilient bell-shaped membrane which permits a peripheral discharge to atmosphere.

Figure 2:
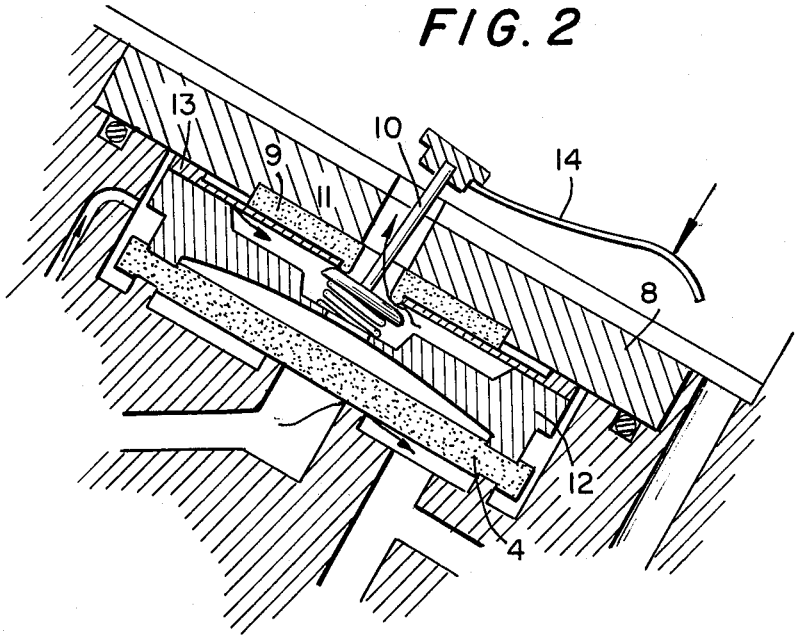
FIG. 2 is a fragmentary axial sectional view, in a larger scale, of a service valve in the opening position thereof.

The operation of the dispensing device according to the invention will be hereinafter described with particular reference to FIG. 2.

The compressed air or gas reaches the floating valves through the central bore of said rotating diverter 16 and through said main ducts 15 and balance ducts 17. In the normal condition, when diaphragm 6 is not urged, said valve 10 is co-axial with the device and therefore completely engages said annular projecting sealing bead of said embedded sealing gasket 9 and closes its central hole. In the chamber above said dispensing valve 4 the same pressure is present as in the feeding duct 15; inasmuch as the exit of this duct is closed by said valve 4 that is urged by the pressure above, said compressed air or gas is conveyed into the auxiliary duct 17 leading into said annular chamber around said spacer member 12. As stated above, the upper and peripheral surfaces of said spacer member have an irregular or rough finishing so that the fluid seeps with damped force into the chamber of valve 4 so as to establish a status of balance or equilibration by loading valve 4 from above, as already stated. As soon as pressure in chamber 5, under diaphragm 6, decreases due to an inspiration effected in chamber 2 and transferred through ducts 3 and 3*a*, the arm 14, urged by diaphragm 6, is tilted and in turn tilts the valve 10 making it pivot on said annular bead of gasket 9 so as to open the central upward passage. This passage is somewhat large and consequently the pressure above valve 4 decreases so that the central portion of said valve raises due to the feeding pressure urging it from below. Consequently, as indicated by the arrow in FIG. 2, the feeding air can pass from duct 15 to duct 3 and thence to the respiration chamber 2. At this point, the diaphragm 6 and the valve 10 return to their normal position and, therefore, said diaphragm valve 4 closes again automatically until a new inspiration is effected. During expiration, the expired gas flows through duct 3*a* and out to the atmosphere through the opening 18 wherein the non-return valve 7 is mounted.

Inasmuch as the auxiliary duct 17 is large, and said seepage rough surfaces of the spacer member 12 are also large, the device according to the invention, while granting an efficient damping effect on the flow, affords a constant passage and, therefore, a reliable and safe operation, which is very important particularly for underwater equipment. Moreover, the considerable length of the control arm 14 and the extreme proximity of the pivotal contact of valve 10 make the servo-control device very sensitive in operation and, therefore, afford an extremely easy and confortable respiration for the user of the dispensing device according to the invention.

It is to be understood that the illustrated positions of ducts 3 and 15 could be inverted, obviously modifying accordingly the positions of ducts 3*a* and 17, without affecting the described mode of operation.

It is also to be noted that in case either of the two valves fails to operate, the broken-down valve can be cut off by simply rotating through 90°, in a clockwise or anticlockwise direction, said diverter 16 so that either of the two ducts 15 will no longer register with the central feeding duct of said diverter.

Obviously, as stated above, the dispensing device according to the invention can be realized also with a single floating valve or with more than two floating valves, and can be used for any other purpose after being suitably modified or improved, if necessary, still within the basic principle of the invention.

We claim:

1. A dispensing device for a respiration apparatus, which comprises:

(a) a compressed gas inlet means for connection to a source of compressed gas, a compressed gas outlet means for delivering compressed gas to a person and an expiration outlet means for exhausting gas during expiration thereof; and (b) control valve means for controlling the flow of compressed gas in response to the respiration of the user, comprising:

(i) a first chamber, a blind supply diaphragm in said first chamber reciprocably movable between a normally closed position and an open position, an annular wall means enclosing said chamber and having an irregular engagement surface and an annular washer means in abutting engagement with said wall means engagment surface, said abutting wall means and washer means providing a labyrinth-like passage for seepage therethrough of said compressed gas from said gas inlet means into said chamber, the pressure of said seeped compressed gas acting upon one side of the supply diaphragm; first conduit means leading from said gas inlet to the other side of the supply diaphragm; second conduit means leading from said other side of the supply diaphragm to said gas outlet; said supply diaphragm being operable to establish communication between said first and second conduit means when moved to the open position and to cut off such communication when in said closed position; and an outlet in said first chamber; and (ii) a second chamber having an inlet and an outlet, third conduit means for establishing communication between said first chamber outlet and said second chamber inlet; service valve means for controlling flow of gas through said third conduit means and having an operating arm urged by spring force to a first position in which said service valve closes said third conduit, said operating arm being reciprocably movable between said first position and a second position in which said service valve means opens said third conduit means, and a control diaphragm in contact with said operating arm; and a fourth conduit means for establishing communication between said second chamber outlet and said compressed gas outlet means and said expiration outlet means, said control diaphragm being operable to move said operating arm against the spring force to the second position whenever the user of the device inhales compressed gas through said gas outlet means.

2. Apparatus according to claim 1, wherein said annular washer means has an annular gasket means mounted coaxially thereon and surrounding the inlet to the third conduit means, said gasket means having a bead around its inner aperture and projecting into said first chamber to form a valve seat for said service valve means, and said service valve means comprises a disc-shaped valve member for closing said valve seat and a valve stem perpendicular to said valve member, said operating arm being mounted on said valve stem, said control diaphragm being operable when actuated by the inhaling of the user to act directly upon said operating arm so as to tilt said valve member with respect to the normal axis of the valve stem, which tilting movement opens a leak through which the compressed gas can flow out of said first chamber so as to unbalance the system temporarily.

3. Apparatus according to claim 1, wherein there are a pair of identical said control valve means (b) and a distributor means is provided in said gas inlet means for delivering compressed gas to one or both of said control valve means.

* * * * *